United States Patent [19]

Wiley

[11] 4,021,659

[45] May 3, 1977

[54] PROJECTOR LAMP REFLECTOR

[75] Inventor: Emmett H. Wiley, Chesterland, Ohio

[73] Assignee: General Electric Company, Schenectady, N.Y.

[22] Filed: Oct. 30, 1975

[21] Appl. No.: 627,085

[52] U.S. Cl. ..... 240/41.36; 240/103 R

[51] Int. Cl.[2] ..... F21V 7/09; F21V 7/00

[58] Field of Search ..... 240/103 R, 41 BM, 41.36, 240/41.3

[56] References Cited

UNITED STATES PATENTS

| | | | |
|---|---|---|---|
| 1,253,813 | 1/1918 | Gray | 240/103 R X |
| 1,394,319 | 10/1921 | McNeal | 240/103 R X |
| 1,639,363 | 8/1927 | Balsillie | 240/103 R |
| 2,266,190 | 12/1941 | Griese | 240/103 R |
| 2,686,255 | 8/1954 | Pascucci | 240/103 R |
| 2,913,570 | 11/1959 | Gough et al. | 240/103 R X |
| 3,314,331 | 4/1967 | Wiley | 240/41.3 X |
| 3,428,800 | 2/1969 | Levin et al. | 240/41.3 |
| 3,511,983 | 5/1970 | Dorman | 240/41.36 X |
| 3,662,165 | 5/1972 | Osteen et al. | 240/41.36 X |
| 3,662,165 | 3/1970 | Osteen | 240/103 R |
| 3,825,742 | 7/1974 | Levin | 240/103 R |
| 3,826,913 | 7/1974 | Downing | 240/103 R |

FOREIGN PATENTS OR APPLICATIONS

| | | | |
|---|---|---|---|
| 667,539 | 6/1929 | France | 240/103 R |
| 1,081,393 | 12/1960 | Germany | 240/103 R |

*Primary Examiner*—George H. Miller, Jr.
*Attorney, Agent, or Firm*—Norman C. Fulmer; Lawrence R. Kempton; Frank L. Neuhauser

[57] ABSTRACT

The concave reflecting surface of a projector lamp reflector is shaped in the form of a plurality of radial bands and a plurality of concentric circular bands to provide a multiple faceted surface for spreading the image formed by the reflector into a larger and smoother pattern and reducing the amount of imaging of a lamp filament and support post in the projected light pattern. Longer life and improved reproducibility of the molding tool are achieved.

3 Claims, 11 Drawing Figures

Fig. 1
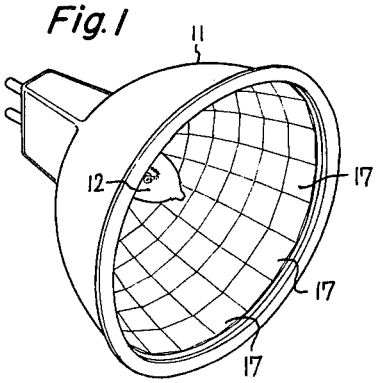
Fig. 2
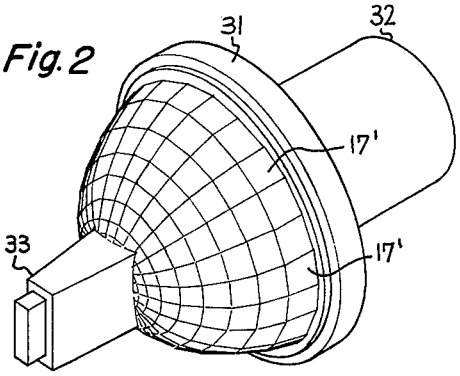
Fig. 3
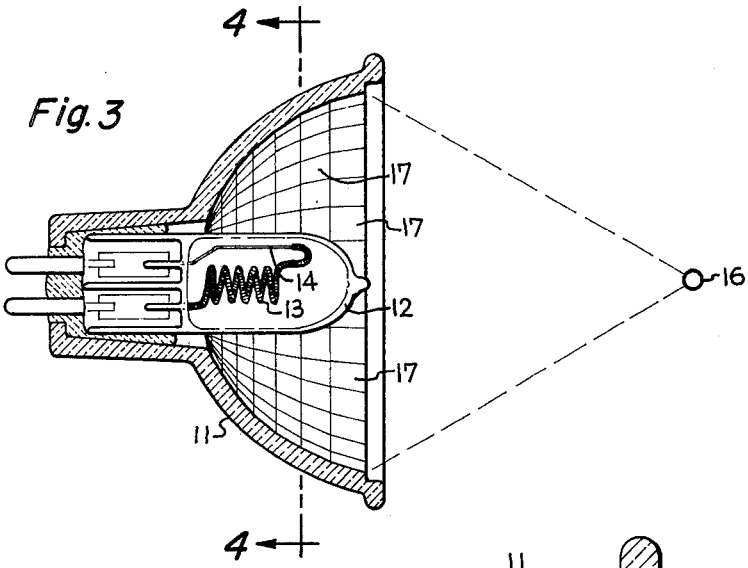
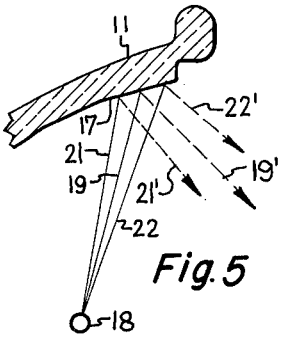
Fig. 5
Fig. 4
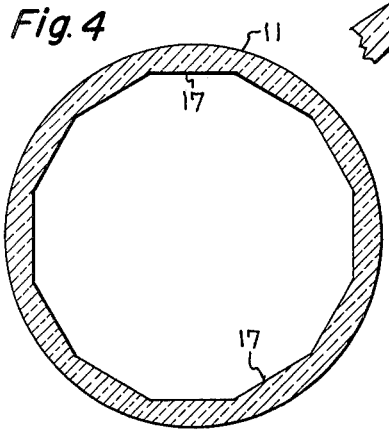
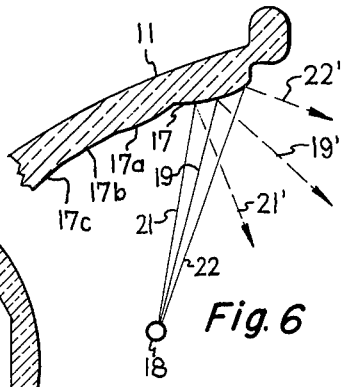
Fig. 6
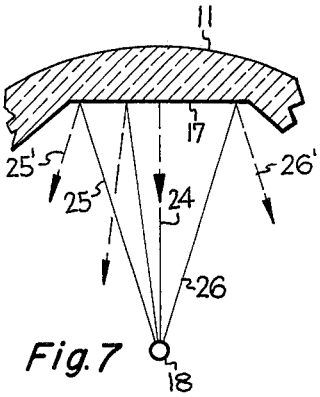
Fig. 7

PROJECTOR LAMP REFLECTOR

BACKGROUND OF THE INVENTION

The invention is in the field of projector lamps and reflectors wherein it is desired that the projected light pattern be free of an image of the filament of the lamp.

Imaging of the lamp parts has been reduced in the past by providing a stippled reflecting surface, and also by providing radial banding. A stippled surface causes spreading of the light beam in all directions, including laterally and radially, whereas radial banding causes the light beam to spread only in lateral directions. A drawback of the stippled surface is that its molding tool wears quickly with use, so that successively molded reflectors will have progressively different surfaces. Also, the molding tools, made by peening a steel surface, cannot be duplicated accurately.

SUMMARY OF THE INVENTION

Objects of the invention are to provide a concave reflector, and such a reflector and incandescent lamp combination, which projects a light pattern that is free of images of the lamp filament and/or filament support post and any other parts of the lamp, and to accomplish this result in such a way that the reflector molding tools will have longer life and will be accurately reproducible as compared to conventional peened molding tools made by impacting with metal balls or by hand peening with a tool.

The invention comprises, briefly and in a preferred embodiment, a concave projection reflector of which the concave reflecting surface is shaped in the form of a plurality of radial bands and a plurality of concentric circular bands to provide a multiple keystone-faceted surface. The number, size and shape of the two types of bands is chosen to provide the facet shapes such as to virtually eliminate projected images of the lamp's filament, support post, and any other parts in the lamp. The facets can be flat, or convex in one or both directions, or a combination of flat and convex facets, to affect the elimination of lamp imaging. The facets can also vary in size and curvature. Since the facets on the molding tool are much larger than the peening or stippling on conventional molding tools, the tools have a longer useful life before the edges of the facets become worn and rounded so as to be no longer useful and to require reshaping. Also, the molding tools of the invention are accurately definable and reproducible, as they can be made by successively indexing the tool in a fixture and successively grinding or milling the facets. U.S. Pat. No. 3,314,331 to Emmett Wiley describes a way of mounting a reflector lamp in a projector.

BRIEF DESCRIPTION OF THE DRAWINGS

FIG. 1 is a perspective view of a lamp and reflector combination in accordance with a preferred embodiment of the invention.

FIG. 2 is a perspective view of a molding tool used in forming the concave surface of the reflector of FIG. 1.

FIG. 3 is a cross sectional side view of the lamp and reflector of FIG. 1.

FIG. 4 is a cross sectional view of the reflector configuration taken on the Line 4-4 of FIG. 3.

FIG. 5 is a side sectional view of a portion of the reflector, showing how light rays from the lamp are divergently reflected by a facet of the reflector surface.

FIG. 6 is similar to FIG. 5, except that some facets are convex.

FIG. 7 is a portion of the reflector of FIG. 4, and shows divergent reflection of light rays by a facet.

DESCRIPTION OF THE PREFERRED EMBODIMENT

Figure 9:
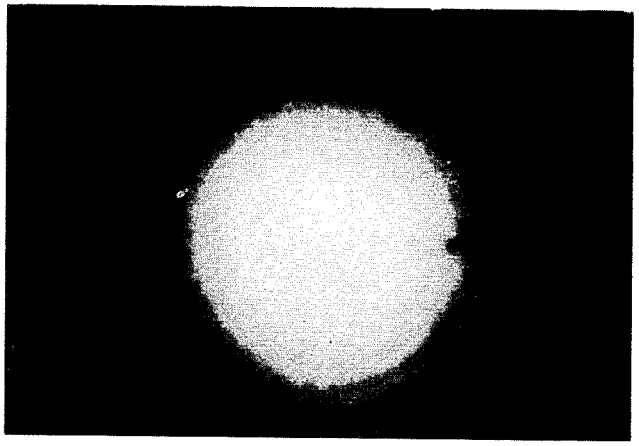
FIG. 8 through 11 are photographs of light patterns projected on a screen, by a reflector having a plain surface, a reflector having circular bands only, a reflector having both circular bands and radial bands and a reflector having both circular bands and radial bands with the facets being convexed as shown in FIG. 6, respectively, using lamps of the type shown in FIG. 3, respectively.
Figure 11:
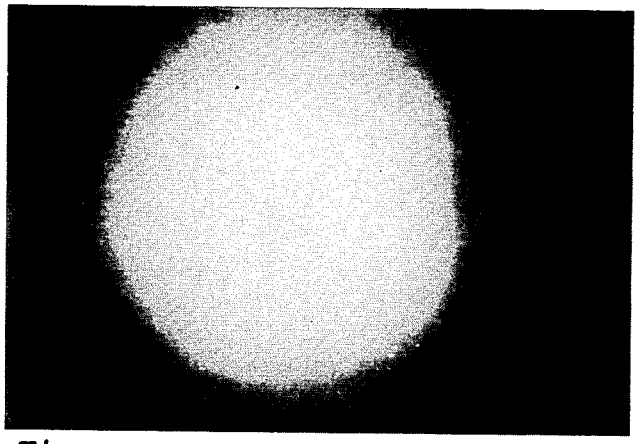

A concave reflector 11 which may be of glass having its interior surface metalized or coated with multiple layers of materials so as to reflect light and transmit heat, is provided with an incandescent lamp 12 positioned therein. The particular lamp shown contains a helical filament 13 positioned with its axis along the optical axis of the reflector 11 and is located generally at or near a focus point of the reflector. A wire post conductor 14 is provided in the lamp to support the front end of the filament 13 and to provide a path for current thereto. The reflector 11 is an elliptical type which focuses the light beam toward a point 16 in front of the reflector, it being understood that the point 16 is of considerable finite size because the filament light souce 13 has a finite size.

In accordance with the invention, the inside surface of the reflector 11 is provided with a plurality of radial bands and a plurality of concentric circular bands which mutually intercept one another to provide a plurality of keystone shaped facets 17 on the reflecting concave surface.

Each of the facets 17 slightly diverges the pattern of light reflected therefrom, as illustrated in FIGS. 5 through 7. As shown in FIG. 5, light from a point 18 on the light source following a path 19 to the center of a facet 17, will be reflected along a path 19' the same as though the reflector had a plain non-faceted surface. A light beam following a path 21 to a point near the rear of the facet 17 will follow a path 21' diverted slightly downwardly from the path 19', and a light beam following a path 22 toward the front edge of the facet will be diverged upwardly so as to follow a path 22' after being reflected. Thus, each of the facets 17 contributes toward divergence of the reflected light in a series of planes passing through the axis of the reflector. FIG. 6 illustrates that if the facets 17 are provided with convex curvatures, the pattern of reflected light will be diverged more than is the case with flat facets. FIG. 7 illustrates that a light beam 24 following a path toward center of a facet 17 will be reflected in a plane passing through the axis of the reflector. Light beams 25 and 26 following paths sideways toward edges of the facet 17 will become diverted farther in that direction as indicated by the paths 25' and 26'. This lateral divergence of light beams in directions away from the axis of the reflector reduces and virtually eliminates imaging of the filament post 14 in the projected light pattern, so that no shadow of the post 14 is readily visible on a projection screen. The divergence of the light beam in planes substantially passing through the optical axis of the reflector as shown in FIGS. 5 and 6, reduces and virtually eliminates imaging of the filament 13 in the projected light pattern so that no pattern of the bright filament is readily visible on the projection screen.

Figure 8:
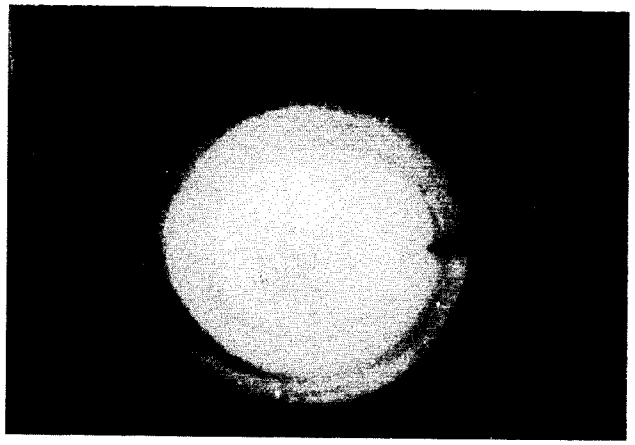
Figure 10:
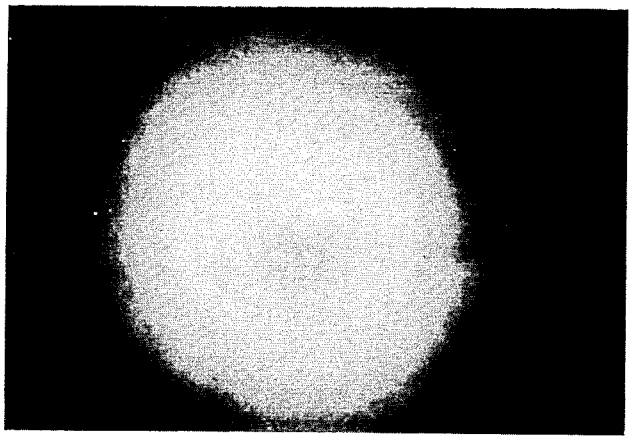

The photographs of FIGS. 8 through 11 were taken of light patterns of projector lamps positioned approximately 12 inches in front of a flat opaque screen, thus simulating conditions when the projector lamps are used for illuminating transparencies in overhead projectors. The light pattern of FIG. 8 is from a projector lamp having a plain non-faceted reflecting surface, and shows a helical bright pattern caused by reflection of the heated filament of the lamp, and also shows (toward the right) an elongated dark shadow caused by the filament post 14 in the lamp. The pattern shown in the photograph FIG. 9, made with a reflector having only concentric circular bands having flat surfaces, shows considerable elimination of the filament imaging. FIG. 10, of a light pattern made from a projector lamp providing with both circular and annular banding to provide flat-surfaced facets, illustrates substantial elimination of the post shadow as well as the filament image and the photograph of FIG. 11, of a light pattern made with a projector lamp having a reflector provided with both circular and annular banding, and with the facets convexed as illustrated in FIG. 6, reveals substantially complete elimination of both the post shadow and filament image.

The reflector of the invention reduces imaging of the lamp filament and other parts at least as well as can be achieved by a stippled reflector surface, and achieves this with greater design flexibility of light spread control, and also achieves greater uniformity and reproducibility from lamp to lamp, and the lamps have more uniform and reproducible overall light patterns, because the molding tools for the concave reflector surface can be reproduced identically, and they have longer life as compared with stippled reflector surfaces made with a peened molding. FIG. 2 shows a molding tool 31 made of metal such as hardened steel and having molding facets 17'. On the molding surface thereof, which is generally circular in cross section on a plane perpendicular to the axis thereof, and is of a partial ellipse configuration in cross section taken on a plane passing through the axis thereof, the facets 17' can be ground or milled onto the surface of the molding tool 31, by holding the tool by means of a shank 32 in a rotary indexing holder, and successively indexing the tool 31 in a rotary manner a given number of degrees, and at each such position grinding or milling a single facet or all of the facets of an annular band by successively tilting either the tool 31 or the grinding wheel or milling wheel. Alternatively, all facets of a radial band can be formed simultaneously by a suitably shaped grinding wheel or milling cutter. The nose 33 of the tool may be a separate piece attached after the facets are formed. The molding tool and method of making it, not only achieves more accurate reproducibility of the tools, as compared with making a peened molding tool, but also lasts longer than a peened tool because the facets 17 are considerably larger than the individual deformations in a peened tool.

The number of facets 17 that are provided on a concave reflector surface, and whether they are generally square or rectangular in shape, and/or are convexly curved as shown in FIG. 6, can be varied considerably for obtaining different light spreads, with good results. In one successful design of the invention, the facets 17 have an appearance as shown of FIGS. 1 and 3 of the drawing, these figures being approximately actual size of the lamp. By making the facets 17 relatively large, the molding tool 31 will last longer before needing to be replaced or reground, because it can withstand more wear (not only from molding operation, but from being repolished) until the edges of the facets become sufficiently rounded to adversely affect performance of the projector lamp. The maximum size of the facets 17 is limited mostly by adverse optical pattern effects, and by considerations of thickness and strength of the glass wall of the reflector.

The invention achieves individual control over imaging of various lamp parts, thus improving versatility of reflector design as compared with stippled reflectors. For example, the radial lengths of the facets (as viewed in FIG. 5) can be increased to further reduce imaging of filament without substantially affecting the post image. Similarly, the lateral widths of the facets (as viewed in FIG. 7) can be increased to further reduce imaging of the post without substantially affecting the filament image. The control of light spread can further be achieved, in accordance with the invention, by providing facets of varying lengths between the apex and rim of the reflector, for example shorter toward the apex and longer toward the rim as shown in FIGS. 1 and 3. Also, the radii of curvature of convex facets can be made different for different facets as shown by the facets 17 and **17*a* in FIG. 6. Further, a combination of flat and convex facets can be provided as shown by the convex facets 17, 17*a* and flat facets 17*b*, 17*c* in FIG. 6. Combinations of the foregoing facet configurations can be employed. By these techniques, the reflected light divergence, and reduction of imaging, can be tailored for various parts in various positions in the lamp 12**.

While preferred embodiments and modifications of the invention have been shown and described, various other embodiments and modifications thereof will become apparent to persons skilled in the art and will fall within the scope of the invention as defined in the following claims.

What I claim as new and desire to secure by Letters Patent of the U.S. is:

1. A reflector and lamp combination comprising a reflector having 9 concave reflecting surface shaped to form a plurality of radial bands and a plurality of circular bands each of which intersects each of said radial bands thereby forming a plurality of reflective facets, and a lamp positioned within the concavity of said reflector and comprising a helical filament positioned along the optical axis of said reflector and said lamp also comprising a filament conductor positioned substantially parallel to and spaced from said filament, whereby in operation said reflective facets laterally diverge light from said filament thereby reducing optical imaging of said filament conductor and axially diverge light from said filament thereby reducing optical imaging of said filament.

2. A combination as claimed in claim 1, in which at least some of said facets are flat.

3. A combination as claimed in claim 1, in which at least some of said facets are curved convexly.

* * * * *